United States Patent [19]

Florens et al.

[11] 4,186,010

[45] Jan. 29, 1980

[54] SILVER HALIDE ELEMENTS WITH POLYMERS CONTAINING KETOIMINOGUANIDINIUM GROUPS

[75] Inventors: Raymond L. Florens, Edegem; Daniël M. Timmerman, Mortsel, both of Belgium

[73] Assignee: Agfa-Gevaert, N.V., Mortsel, Belgium

[21] Appl. No.: 567,109

[22] Filed: Apr. 11, 1975

[30] Foreign Application Priority Data

Apr. 26, 1974 [GB] United Kingdom ..... 18425/74

[51] Int. Cl.[2] ..... G03C 5/30; G03C 1/72

[52] U.S. Cl. ..... 430/627; 430/963; 430/355

[58] Field of Search ..... 96/81, 94 R, 114, 67

[56] References Cited

U.S. PATENT DOCUMENTS

| | | | |
|---|---|---|---|
| 2,882,156 | 4/1959 | Minsk | 96/114 |
| 3,482,982 | 12/1969 | Miyata | 96/94 R |
| 3,885,970 | 5/1975 | Miyahara | 96/94 R |

OTHER PUBLICATIONS

Zelikman et al, Making and Coating Photographic Emulsions, Focal Press Limited, 1964.

*Primary Examiner*—Jack P. Brammer
*Attorney, Agent, or Firm*—A. W. Breiner

[57] ABSTRACT

A photographic element is described comprising an emulsion layer of low gelatin to silver halide ratio, the emulsion comprising a polymeric compound containing recurring units with ketoiminoguanidinium groups in the side chain to reduce formation of pressure marks.

5 Claims, No Drawings

SILVER HALIDE ELEMENTS WITH POLYMERS CONTAINING KETOIMINOGUANIDINIUM GROUPS

The present invention relates to gelatino silver halide emulsions of low gelatin to silver halide ratio and to rapid processing of photographic elements containing silver halide emulsion layers of low gelatin to silver halide ratio.

Techniques for rapid processing exposed photographic elements are known. Usually, rapid processing occurs in automatic processing machines where the materials are conducted from one processing station to another by means of roller pairs or other conveyor means. The severe physical conditions to which the elements are subjected in these processing apparatus e.g. pressure and usually also elevated temperature above 30° C., generally impair the photographic properties of the photographic elements treated. This is quite apparent when, in order to accelerate penetration of the processing solutions and thus to permit rapid processing times, silver halide emulsions are used having a low gelatin to silver halide ratio. The repeated pressure marks resulting in the rapidly machine processed photographic elements e.g. from roller pairs and other guiding means are highly undesirable, especially in medical radiographic materials.

It has now been found that polymeric compounds, which include both homopolymers and copolymers, comprising recurring monomer units with ketoiminoguanidinium groups in the side chain reduce formation of pressure marks in black-and-white silver halide emulsions of low gelatin to silver halide ratio.

The present invention provides a black-and-white photographic element comprising a support and at least one radiation-sensitive gelatino silver halide emulsion layer wherein the ratio of gelatin to silver to silver halide in the emulsion layer is comprised between about 0.2 and about 0.7, preferably between about 0.3 and about 0.5, and the silver halide emulsion comprises a polymeric compound containing recurring units with ketoimino-guanidinium groups in the side chain.

The present invention also provides a method of producing photographic images by rapid black-and-white processing in an automatic processing machine of exposed photographic silver halide elements comprising at least one gelatino silver halide emulsion layer wherein the ratio of gelatin to silver halide is comprised between about 0.2 and about 0.7, preferably between about 0.3 and about 0.5 and the silver halide emulsion comprises a polymeric compound containing recurring units with ketoiminoguanidinium groups in the side chain.

Polymeric compounds wth ketoiminoguanidinium groups in the side chain have been described for use in photographic elements e.g. as mordanting agents for anionic compounds which include light-absorbing dyes and colour couplers (cfr. Belgian Pat. No. 764,443, U.S. Pat. No. 2,882,156 and published German patent application No. 2.200063) and for use as antisticking agents in surface coatings of photographic elements (cfr. published German patent application No. 2348636). It was surprising to find that in emulsions with low ratio of hydrophilic colloid binder to silver halide these polymers effectively reduce formation of pressure marks upon processing.

The polymeric compounds with ketoiminoguanidinium groups in the side chain are homopolymers or copolymers obtained by condensation of aminoguanidine or salts thereof with either homopolymers or copolymers comprising recurring units with a keto-carbonyl group in the side chain e.g. vinyl alkyl ketone units, vinyl aryl ketone units, acroleine units, vinylacetophenone units, N-alkyl(meth)acrylamide units or alkyl(meth)acrylate units with ketocarbonyl group in the alkyl group, etc. or with the monomer containing in the side-chain recurring units with a ketocarbonyl group in the side-chain and then homopolymerizing or copolymerizing the resulting monomeric condensation product.

The recurring units with ketoiminoguanidinium group in the side chain can be represented by the formula:

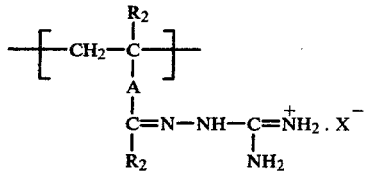

wherein $R_1$ is hydrogen or methyl, $R_2$ is hydrogen, alkyl, preferably $C_1$–$C_4$ alkyl e.g. methyl, or aryl e.g. phenyl, A is a single bond or a bivalent organic group e.g. -CONH alkylene-, —COOalkylene- and phenylene, and $X^-$ is an acid group of an inorganic acid e.g. hydrochloric acid or an organic acid e.g. lactic acid, glycolic acid, alkane sulphonic acids of from 1 to 4 carbon atoms e.g. methane sulphonic acid or the acid radical of a saturated monobasic aliphatic carboxylic acid containing from 2 to 4 carbon atoms e.g. acetic acid, propionic acid or butyric acid.

In addition to recurring units with ketoiminoguanidinium groups in the side chain, the polymers used in accordance with the present invention may comprise units of other copolymerised ethylenically unsaturated monomers for example (meth)acrylamide units, N-alkyl(meth)acrylamide units, alkyl (meth-)acrylate units, styrene units, acrylonitrile units, N-vinylpyrrolidone units, vinyl acetate and other vinyl ester units, and unreacted units with ketocarbonyl group in the side chain.

Particularly suitable compounds are homopolymers and copolymers comprising recurring units with ketoiminoguanidinium group in the side chain derived from vinyl alkyl ketone units e.g. vinyl methyl ketone units, diaceton(meth)acrylamide units and acetonyl(-meth)acrylate units.

The effectiveness of the polymeric compounds for use according to the present invention is due to the recurring units with ketoiminoguanidinium group in the side chain, and therefore homopolymers are preferred. If copolymers are employed, the copolymerised monomers should be such that they have no deleterious effect on the photographic properties of the silver halide emulsion layers. The copolymers should be soluble in the aqueous gelatin medium of the emulsion. Therefore, the polymer should comprise at least 10 mole % of ketoiminoguanidinium units in the case of hydrophobic comonomeric units e.g. N-vinyl pyrrolidone, acrylamide and methacrylamide units and at least 30 mole % of ketoiminoguanidinium units in the case of hydrophobic comonomeric units e.g. t.butylacrylamide, alkyl(meth-)acrylate, styrene and acrylonitrile units. Generally, the copolymers employed preferably comprise at least 30 mole % of ketoiminoguanidinium units.

Though the molecular weight of the polymeric compounds used is of minor importance and the best range can be easily determined by means of some simple tests, the compounds generally have a molecular weight comprised between about $10^3$ and about $10^7$.

The polymeric compounds can be prepared as described hereinbefore by condensation before or after polymerisation of aminoguanidine or a salt thereof with the corresponding keto compound. A preferred method is that, according to which the polymeric compound comprises exclusively or the exactly desired amount of recurring units with ketoiminoguanidinium groups in the side chain by first condensing the aminoguanidine or salt thereof with a monomer comprising a ketocarbonyl group in the side chain and then polymerizing the guanidylketimine compound, if desired with other comonomers.

The polymeric compounds may be added to the silver halide emulsion during no matter what step of emulsion preparation, preferably just before coating on a suitable support e.g. paper, or film such as cellulose triacetate and polyethylene terephthalate.

The amount of polymeric compound employed in the light-sensitive silver halide emulsion layer depends on the particular compound, the particular type of emulsion and the desired effect and can vary within very wide limits. The optimum amount of each individual polymeric compound to be added is best determined for each particular type of emulsion by trial. Generally, the most suitable concentration is comprised between about 0.5 g and about 15 g preferably between about 1 g and 10 g per mole of silver halide.

According to a preferred embodiment of the present invention, the polymeric compounds are incorporated into the silver halide emulsions together with known compounds for increasing the density of developed silver i.e. compounds increasing the covering power of the emulsions, especially when maintenance of speed and contrast is desirable, e.g. dextran, lactose, N-vinylpyrrolidone and polymers derived from maleic anhydride (e.g. of the type described in French Patent 1,501,717) more particularly alkali salts of maleic anhydride polymers. Particularly suitable for use together with the polymers with ketoiminogyanidinium groups in the side chain are dextran and polymers derived from maleic anhydride, more particularly alkali salts of maleic anhydride polymers with low molecular weight which have little effect on the viscosity of the emulsion e.g. maleic anhydride polymers as alkali salt having a viscosity $[\eta]$ from 0.10 to 0.20 $dlg^{-1}$ measured in 0.1 N sodium chloride at 25° C. Representative examples of such maleic anhydride polymers are co(maleic anhydride/styrene) (50/50 mole %) as alkali salt with $[\eta]=0.085$ $dlg^{-1}$ (as anhydride) in acetone at 25° C., co(N-vinylpyrrolidone/maleic anhydride) (50/50 mole %) as alkali salt with $[\eta]=0.068$ $dlg^{-1}$ (as anhydride) in pyridine at 25° C.

The compounds increasing the covering power of the emulsion may be used in largely varying amounts dependent on the particular type of emulsion and the particular compound used. Generally they are used in amounts varying from about 10 to about 75 % by weight, preferably from about 20 to about 60 % by weight, relative to the weight of hydrophilic colloid, more particularly gelatin in the emulsion.

The polymeric compounds of use according to the present invention may be used in any type of light-sensitive material that after exposure is intended to be mechanically processed at elevated temperature. Various silver salts may be used as light-sensitive salt, e.g. silver bromide, silver iodide, silver chloride, or mixed silver halides, e.g. silver chlorobromide or silver bromoiodide. The invention is of particular importance for rapid processing of silver bromoiodide emulsions.

The emulsion may be a negative emulsion or a direct-positive emulsion, which comprises fogged silver halide. In direct-positive emulsions fogging may be effected by known means, e.g. by light and preferably, by chemical sensitization to fog e.g. by means of reducing agents such as hydroxylamine, hydrazine, formaldehyde, tin(II)chloride, thiourea dioxide, etc., and/or by means of noble metal compounds such as gold compounds. In addition thereto fogging may also occur by increasing the pH of the emulsion by means of alkaline substances such as sodium or potassium hydrozide.

The silver halides are dispersed in the common hydrophilic colloids such as gelatin, casein, zein, polyvinylalcohol, carboxymethylcellulose, alginic acid, etc., gelatin, however, being favoured.

The silver halide emulsions of the radiation-sensitive elements comprising the polymeric compounds in accordance with the present invention may be chemically as well as spectrally sensitized. They may be chemically sensitized by any of the accepted procedures. The emulsions may be digested with naturally active gelatin or sulphur compounds may be added such as allyl thiocyanate, allyl thiourea, sodium thiosulphate, etc. The emulsions may also be sensitized by means of reductors, e.g. tin compounds as described in our United Kingdom Pat. Spec. 789,823 filed Apr. 29, 1955 by Gevaert Photo-Producten N.V. and by means of small amounts of noble metal compounds, e.g. of gold, platinum, palladium, iridium, ruthenium and rhodium as described by R. Koslowsky Z.wiss.Phot. 46, 67-72 (1951). Representative noble metal compounds are ammonium chlorpalladate, potassium chloroplatinate, potassium chloroaurate and potassium aurithiocyanate.

The emulsions may further comprise compounds that sensitize the emulsion by development acceleration for example alkylene oxide polymers. These alkylene oxide polymers may be of various type e.g. polyethylene glycol having a molecular weight of 1500 or more, alkylene oxide condensation products or polymers as described among others in U.S. Pat. Specs. 1,970,578 of Conrad Schoeller and Max.Wittner issued Aug. 21, 1934, 2,240,472 of Donald R. Swan issued Apr. 29, 1941, 2,423,549 of Ralph Kinsley Blake, William Alexander Stanton and Ferdinand Schulze issued July 8, 1947, 2,441,389 of Ralph Kinsley Blake issued May 11, 1948, 2,531,832 of William Alexander Stanton issued Nov. 28, 1950, and 2,533,990 of Ralph Kinsley Blake issued Dec. 12, 1950, in United Kingdom Pat. Spec. 920,637 filed May 7, 1959, 940,051 filed Nov. 1, 1961, 945,340 filed Oct. 23, 1961 all by Gevaert Photo-Producten N.V. and 991,608 filed June 14, 1961 by Kodak Co. and in Belgian Pat. Spec. 648,710 filed June 2, 1964 by Gevaert Photo-Producten N.V. Other compounds that sensitize the emulsion by development acceleration and that are suitable for use in combination with the polymeric compounds of use according to the invention are the quaternary ammonium and phosphonium compounds and ternary sulphonium compounds as well as onium derivatives of amino-N-oxides as described in United Kingdom Pat. Spec. 1,121,696 filed Oct. 7, 1965 by Gevaert-Agfa N.V.

The emulsions may be spectrally sensitized e.g. by means of the common methine dyes such as neutrocyanines, basic or acid carbocyanines, rhodacyanines, hemicyanines, styryl dyes, oxonol dyes and the like. Suchlike spectrally sensitizing dyes have been described by F. M. Hamer in "The Cyanine Dyes and related Compounds" (1964). Direct-positive emulsions may comprise desensitizing dyes e.g. as described in United Kingdom Pat. Spec. 1,155,404 filed May 9, 1966 by Gevaert-Agfa N.V.

The emulsions may comprise the common emulsion stabilizers e.g. homopolar or salt-like compounds of mercury with aromatic and heterocyclic rings (e.g. mercaptotriazoles) simple mercury compounds, mercury sulphonium double salts and other mercury compounds of the kind described in Belgian Pat. Spec. 524,121 filed Nov. 7, 1953 by Kodak Co., 677,337 filed March 4, 1966, 707,386 filed Dec. 1, 1967 and 709,195 filed Jan. 11, 1968 all by Gevaert-Agfa N.V. Other suitable emulsion stabilizers are the azaindenes, particularly the tetra- or pentaazaindenes and especially those substituted by hydroxy- or amino groups. Suchlike compounds have been described by Birr in Z.wiss.Phot. 47, 2-58 (1952). The emulsions may further comprise as stabilizers heterocyclic nitrogen-containing mercapto compounds such as benzothiazoline-2-thione and 1-phenyl-5-mercapto-tetrazole, sulphinic acids such as benzenesulphinic acid and toluenesulphinic acid, thiosulphonic acids such as benzenethiosulphonic acid, toluenethiosulphonic acid, p-chlorobenzenethiosulphonic acid sodium salt, propylthiosulphonic acid potassium salt, butylthiosulphonic acid potassium salt, etc. Especially suitable are the amide stabilizers e.g. acetamide described in British Pat. No. 1,325,878 filed Nov. 3, 1969 by Gevaert-Agfa N.V. They may further comprise or be developed in the presence of compounds that are particularly effective as antifoggants for materials that are processed at elevated temperatures e.g. heterocyclic compounds with nitro-substituents e.g. nitroindazole and nitrobenzo-triazole as described in French Pat. Spec. 2,008,245 filed May 9, 1969 by Eastman Kodak Co., nitrobenzylidene pyridinium and nitrobenzylidene quinolinium compounds as well as the onium compounds described in published German Pat. application 2040876 filed Aug. 18, 1970 by Kunishiroku Photo Industry Co. Ltd.; further the nitrobenzene compounds described in co-pending application 43,517/71 filed Sept. 17, 1971 by Agfa-Gevaert N.V. and the nitrile compounds described in co-pending application 43,518/71 filed Sept. 17, 1971 by Agfa-Gevaert N.V.

The photographic silver halide materials may further comprise surface-active compounds, e.g. the fluorinated surfactants of Belgian Pat. Spec. 742,680 filed Dec. 5, 1969 by Gevaert-Agfa N.V., plasticizers, matting agents, e.g. polymethyl methacrylate and silica particles, hardening agents e.g. formaldehyde, dialdehydes, halogensubstituted aldehyde acids such as mucochloric and mucobromic acid, hardening accelerators e.g. resorcinol, phloroglucinol, etc.

Usually in the rapid automatic processing of radiationsensitive silver halide elements it is preferred to use hardening developers. In these developers the hardening agent is generally an aldehyde hardener particularly aliphatic dialdehydes e.g. maleic aldehyde and glutaraldehyde which may be used as such or in the form of their bisulphite addition products.

The following examples illustrate the present invention.

EXAMPLE 1

An orthochromatic ammoniacal silver bromoiodide emulsion (2.75 % of iodide), for photography of the green fluorescent screen, which comprises per kg an amount of silver halide equivalent to 130 g of silver nitrate and 55 g of gelatin, was divided into several portions. To each of these portions the compounds listed in the table below were added in the amount given per kg of emulsion, prior to coating on a polyethylene terephthalate film support.

The materials were exposed through a continuous wedge with constant 0.15 and then automatically processed in a 90 seconds processing machine. Development occurred for 23 seconds at 35° C. in Agfa-Gevaert's hardening developer for automatic processing G 138, which comprises hydroquinone and 1-phenyl-3-pyrazolidinone as developing agents and glutaraldehyde as hardener.

The sensitometric results are listed in the following table.

The values given for the total speed are relative values with respect to reference material A, the total speed of which has been given a value of 100. The total speed is denoted in the table by the letter S. Fog and gradation are denoted by F and G.

The examination of the quality as regards pressure marks occurs visually. For the quality a value varying from 0 to above 4 is given 0 standing for excellent (no pressure marks) and above 4 standing for poor.

Table

| Material | Compounds added | F | G | S | Value for pressure marks |
|---|---|---|---|---|---|
| A | none | 0.03 | 3.23 | 100 | >4 |
| B | 2.4 g of polymer I | 0.03 | 2.53 | 54 | 2 |
| C | 13.5 g of compound A | 0.05 | 3.50 | 135 | >4 |
| D | 2.4 g of polymer I + 13.5 g of compound A | 0.04 | 2.92 | 71 | 1–2 |
| E | 2.4 g of polymer I + 27 g of compound A | 0.04 | 3.19 | 78 | 1 |

Polymer I is the homopolymer prepared as described in the published German Pat. application 2,200,063 by condensation of the monomeric diacetonacrylamide with aminoguanidinium hydrogen carbonate and subsequent polymerization of the monomeric guanylhydrazone derivative obtained (preparation 16). Compound A = polydextran with average molecular weight of about 70000.

The above results clearly show the beneficial effect of the polymeric material according to the invention on the pressure marks. They also show that whereas dextran has no effect on the pressure marks, improved results are obtained when it is used in combination with the polymer and as compared with the reference material there is no substantial loss in speed and gradation.

EXAMPLE 2

Example 1 was repeated with the difference that the compounds listed in the following table were added to the emulsion portions.

The results attained are as follows.

Table

| Material | Compound(s) added | F | G | S | Value for pressure marks |
|---|---|---|---|---|---|
| A | none | 0.02 | 3.03 | 100 | >4 |
| B | 2.4 g of polymer I | 0.01 | 2.21 | 53 | 1-2 |
| C | 2.4 g of polymer I + 30 g of compound A | 0.03 | 2.74 | 71 | 0 |
| D | 20 g of compound B | 0.03 | 3.43 | 107 | >4 |
| E | 2.4 g of polymer I + 20 g of compound B | 0.01 | 2.81 | 66 | 1 |
| F | 2.4 g of polymer I + g of compound B | 0.02 | 3.00 | 73 | 1 |

Compound B = sodium salt of co(maleic anhydride/-styrene)(50/50 mole %) with $[\eta]=0.085$ $dlg^{-1}$ (as anhydride) in acetone at 25° C. corresponding to $[\eta]=0.178$ $dlg^{-1}$ (as sodium salt) in 0.1 N sodium chloride at 25° C. prepared as follows:

In a 20 liters reaction vessel fitted with stirrer, reflux condenser and cooling spiral, 981 g (10 moles) of maleic anhydride, 936 g (9 moles) of styrene and 47.93 g of azobisisobutyronitrile were dissolved in 18 liters of tetrahydrofuran at room temperature.

The reaction mixture was heated gradually until the mixture refluxes gently. By the exothermic polymerisation heating could be stopped for 2 hours. Heating was then continued to keep the mixture refluxing for 22 hours.

The light viscous polymer solution was cooled to room temperature and poured with vigorous stirring into a mixture of 180 liters of water and 160 ml of hydrochloric acid 23° Be. The polymer that precipitated was filtered off, washed with water and transferred to a 10 liters reaction vessel fitted with stirrer and dropping funnel comprising 5N sodium hydroxide. After addition of 2.5 liters of demineralized water to the reaction mixture, the mixture was heated with stirring to 80° C. The sodium hydroxide was added gradually which caused the polymer to dissolve.

After about 30 min. 2300 ml of sodium hydroxide were added and a clear polymer solution was obtained. Yield : 9.6 liters with a solids content of 248 g per 100 g solution. $[\eta]$measured in 0.1N sodium chloride at 25° C. : 0.178 $dlg^{-1}$.

The above results show that by the combined use of a compound increasing the covering power and polymer I it is possible to obtain a favourable quality as regards gradation, speed and pressure marks.

The same favourable results were obtained when using as polymer, the copolymer comprising 50 mole % of diaceton acrylamide units and 50 mole % of diaceton acrylamide units in which the keto group has been converted into a ketoiminoguanidinium group according to preparation 18 of the published German Pat. application 2,200,063.

EXAMPLE 3

Example 1 was repeated with the difference that another polymeric compound (polymer II) was used for reducing the pressure marks.

The results were as follows.

Table

| Material | Compound(s) added | F | G | S | Value for pressure marks |
|---|---|---|---|---|---|
| A | none | 0.02 | 3.03 | 100 | >4 |
| B | 6 g of polymer II | 0.22 | 2.22 | 50 | 2-3 |
| C | 6 g of polymer II + 20 g of compound B | 0.02 | 3.42 | 72 | 2 |

Polymer II is poly(vinyl methyl keto imino guanidinium acetate) prepared according to the following procedure :

In a 5 liters reaction vessel fitted with stirrer, thermometer and reflux condenser with a cooling mixture of solid carbonic anhydride and acetone, 210 g (3 moles) of freshly distilled vinyl methyl ketone, 390 g (3 moles) of aminoguanidinium hydrogen carbonate and 1000 ml of ethanol were mixed.

The mixture was heated with stirring to 70° C. and 214.5 ml of acetic acid were added dropwise in about 2½ hours while keeping the temperature at 70° C.

The light yellow solution was heated for another 30 min at 70° C. The monomer formed was not isolated but 2.1 g of azo-bisisobutyronitrile were added and the monomer was polymerized for 24 hours at 70° C.

The dark polymer solution was concentrated by evaporation under reduced pressure to a volume of 1200 ml and then poured into ether.

The sticky mass was separated, washed with fresh ether and isolated in the form of a brownish powder.

Yield : 557.0 g. $[\eta]=0.070$ $dlg^{-1}$ in 0.1 N sodium chloride at 25° C.

EXAMPLE 4

Example 1 was repeated with the difference that another polymeric compound (polymer III) was used for reducing the pressure marks.

The results were as follows :

Table

| Material | Compound(s) added | F | G | S | Value for pressure marks |
|---|---|---|---|---|---|
| A | none | 0.04 | 2.70 | 100 | >4 |
| B | 2.4 g of polymer III | 0.04 | 3.04 | 107 | 4 |
| C | 2.4 g of polymer III + 30 g of compound A | 0.05 | 3.18 | 120 | 1 |

Polymer III is co(acrylyloxymethyl, methyl ketoiminoguanidinium acetate/acetonyl acrylate) prepared according to the following procedure :

In a 2 liters reaction vessel with stirrer, nitrogen inlet, thermometer and reflux condenser, 200 g of acetonylacrylate (prepared from sodium acrylate and acetonyl chloride) and 1.5 g of azo-bisisobutyronitrile were dissolved in 700 ml of acetone.

The solution was refluxed - the reflux temperature being at first 70° C. and then decreasing gradually to 57° C. after 24 hours—while introducing nitrogen. After these 24 hours 400 mg of azo-bisisobutyronitrile were added and polymerisation was continued for another 8 hours.

The solution was partly evaporated and then poured into 4 liters of methanol with stirring. Poly(acetonyl acrylate) precipitated in the form of a sticky precipitate.

The precipitate was dissolved in 400 ml of dimethyl formamide and the residual methanol and acetone were removed by evaporation at 80° C. under slightly reduced pressure.

The solution was placed in a 5 liters reaction vessel fitted with stirrer, reflux condenser, thermometer and dropping funnel whereupon another 400 ml of dimethylformamide, 900 ml of methanol and 176 g of aminoguanidinium hydrogen carbonate were added.

The solution was heated to 70° C. and 400 ml of acetic acid was added gradually from the dropping funnel in 80 minutes.

Then, the clear polymer solution was stirred for 4 hours at 70° C. and subsequently poured into 8 liters of acetone.

The copolymer precipitated and was washed with acetone whereupon it was dissolved in water. After adjusting the pH to 4.3 by means of 50 ml of acetic acid, the solution was evaporated to remove residual acetone. Yield : 1.52 liter of 16.5% by weight of aqueous solution. $[\eta]=0.152\ dlg^{-1}$ in 0.1 N sodium chloride at 25° C. Analysis : 20.5% N which corresponds to 89.5% by weight of acrylyloxy methyl, methylketoiminoguanidinium acetate units.

We claim:

1. A black-and-white photographic element comprising a support and at least one radiation sensitive gelatino silver halide emulsion layer wherein the ratio of gelatin to silver halide in the emulsion layer is comprised between about 0.2 and about 0.7 and the silver halide emulsion comprises a compound for increasing covering power selected from the group consisting of dextran and an alkali salt of a low molecular weight meleic anhydride polymer, and a polymeric compound containing recurring units with ketoiminoguanidinium groups in the side chain of the formula:

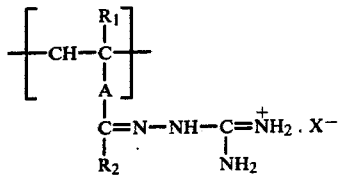

wherein $R_1$ is hydrogen or methyl,

A is a single bond,—CONH alkylene-, -COOalkylene-, or phenylene group, $R_2$ is hydrogen, alkyl or aryl, and $X^-$ is an acid group, said recurring units comprising at least 30 percent of the total units of said polymeric compound and said polymeric compound being present in said emulsion in an amount sufficient to reduce pressure marks during the processing of said element.

2. A photographic element according to claim 1, wherein the polymer comprises besides the units with ketoiminoguanidinium groups in the side chain units of other ethylenically unsaturated monomers.

3. A photographic element according to claim 1, wherein the ratio of gelatin to silver halide in the emulsion layer is comprised between about 0.3 and about 0.5.

4. A photographic element according to claim 1, wherein the polymeric compound is present in an amount comprised between about 0.5 g and about 15 g per mole of silver halide.

5. A photographic element according to claim 1, wherein the compound increasing the covering power is present in an amount from about 10 to about 75 % by weight of gelatin.

6. photographic element according to claim 1, wherein the compound is the alkali salt of a low molecular weight co(moleic anhydride/styrene).

* * * * *